United States Patent [19]

Kohlbach

[11] Patent Number: 4,832,096

[45] Date of Patent: May 23, 1989

[54] DEVICE AND A METHOD FOR THE AIR-FREE FILLING OF RECEPTACLES, IN PARTICULAR FLEXIBLE BAGS

[75] Inventor: Fred R. Kohlbach, Schondorf a.Ammersee, Fed. Rep. of Germany

[73] Assignee: Bowater Packaging Limited, London, England

[21] Appl. No.: 885,917

[22] Filed: Jul. 15, 1986

[30] Foreign Application Priority Data

Jul. 24, 1985 [CH] Switzerland ..... 3206/85

[51] Int. Cl.[4] ..... B65B 3/00; B65B 31/00; B65B 31/02

[52] U.S. Cl. ..... 141/114; 141/316; 141/252; 141/91; 141/65

[58] Field of Search ..... 141/1, 4, 5, 6, 7, 10, 141/39, 46, 48, 65, 114, 252, 253, 275, 316, 91

[56] References Cited

U.S. PATENT DOCUMENTS 3,212,537 10/1965 Hinxlage et al. ..... 141/6

*Primary Examiner*—Henry J. Recla

*Assistant Examiner*—Edward Donovan

*Attorney, Agent, or Firm*—Ralph W. Selitto, Jr.

[57] ABSTRACT

The device for the air-free filling in particular of flexible bags (1) under counterpressure consists of a filling pipe (5) which, with a sealing cone (9), can be guided into a filling and extraction connecting piece (2) of the bag. A filling valve (13) is provided in the direct proximity of the filling-pipe delivery orifice (4), which filling valve (13) is formed from a conical surface (15) of the filling-pipe inner wall (14) and a conical mating piece (18) which is provided on the end of a valve stem (17) which is guided in the filling pipe in axially movable manner.

The product to be filled flows into the filling-pipe inner space (20) through a product feed line, and, via a longitudinal bore (19) made in the valve stem, a vacuum can be applied or a protective gas and also a sterilizing agent can be fed at the area around the delivery orifice (4). This device permits a complete, procedural separation between the product feed to the flexible bag and the evacuating, gassing and sterilizing operations required before or after filling.

18 Claims, 2 Drawing Sheets

DEVICE AND A METHOD FOR THE AIR-FREE FILLING OF RECEPTACLES, IN PARTICULAR FLEXIBLE BAGS

BACKGROUND OF THE INVENTION

The invention relates to a device for the air-free filling of receptacles, in particular of flexible bags having closable filling and extraction connecting pieces and also to a method for the air-free filling of such receptacles with such a device.

So that the greatest possible freedom from germs and also a high protection against oxidation can be ensured during the filling of liquid, pasty, powdery or granular materials, for example in the case of rapidly perishable foodstuffs and drugs, various filling techniques and numerous types of filling machines have been developed. Thus it is known from U.S. Pat. No. 4,120,134 to convey flexible bags, the bag portions to be filled of which are folded together under virtually air-free conditions, from a supply to a holding device which grips on the filling and extraction connecting piece of the corresponding bag and positions the latter at its connecting piece during the subsequent treatment. If the relevant filling and extraction connecting piece is provided with a closure cap, the latter is removed by a corresponding device and the open connecting piece is then set against the delivery orifice of a filling pipe. A pressure element designed in the manner of a rocker is located at the flexible bag portion surface area remote from the filling pipe and causes the bag material wall to be pressed against the bag-inner-side edge of the filling and extraction connecting piece. Therefore the bag cannot unfold before its product is introduced. When the filling pipe is placed on, the desired product can be incorporated into the flexible bag portion, which thereby inflates until the desired filling level is reached. After subsequent removal of the filling pipe, the filling and extraction connecting piece is closed by means of a closure cap and the filled bag is delivered from the filling station.

A series of further measures are known which supplement or modify the fundamental sequence described above. For example, bags can be used, the filling and extraction connecting pieces of which, in addition to or instead of the closure cap, are provided with a closure foil on their opening edge, so that the connecting-piece inner space is also free of air. When the filling pipe is placed on, its delivery orifice can pierce through such a closure foil before the filling operation is started. It is also known to evacuate the flexible bag and the connecting-piece inner space before the start of the filling operation. Following the filling operation, inert gas can be blown in through the filling pipe, so that as little air as possible can pass into the closure area, in particular during the time interval between the removal of the delivery orifice from the filling and extraction connecting piece and the attaching of the closure cap.

A device for the aseptic filling of containers is known from German Offenlegungsschrift No. 2,919,388, in which device the filling pipe, the holding device for the respective filling and extraction connecting piece of the container and the device for the removing and placing on of a closure cap are accommodated in an aseptic chamber which is closed on all sides except for a locating opening for the filling and extraction connecting piece. Consequently, these parts are under a continuous sterilizing agent mist, for example iodine mist, $H_2O_2$/acid mist, etc. These sterilizing agent mists, which are sprayed into the chamber in mist form with sterile-air pressure, keep the entire inner space and also the outer surfaces of the valve, the plug holding grips and the plug sterile, with a positive pressure always prevailing in the chamber during the filling of the product into the flexible bag.

With a similar device to the device described above, it is known from German Offenlegungsschrift No. 2,918,707 to fill so called "bag-in-box" packs of relatively large volume, with the flexible bag portion adapting to the walls of a carton or a box during filling. At the start of the filling operation, a pressure plate engaging from the underside of the flexible bag portion ensures that the bag being filled is lowered uniformly during the filling operation.

Although evacuation of the filling and extraction connecting piece can already take place with the filling pipe placed on, as is known, for example, from the device according to U.S. Pat. No. 4,120,134, these measures are still not adequate to be able to completely eliminate the ingress of air or germs into the filling and extraction connecting piece, above all before and after the filling of the desired product. Just the ingress of air into the delivery orifice and therefore into the inner space of the filling pipe during the transition from one filling operation to the next, despite a subsequent evacuation, can adversely affect product remains which are then filled along with the product. Nor does the design of a chamber (e.g. according to German Offenlegungsschrift No. 2,919,388) holding the entire filling area under positive inert-gas pressure represent a satisfactory solution, because the inert gas, immediately after opening of the closure cap, flows into the flexible bag and inflates the latter. As is apparent, this can cause dosage problems.

SUMMARY OF THE INVENTION

The object of the invention is to create a device and a method for the air-free filling of receptacles, in particular of flexible bags having closable filling and extraction connecting pieces, in which device or method a precisely controllable separation between the product feed on the one hand and the measures for evacuating, gassing and sterilizing on the other hand are ensured and with appropriate measures already being taken on the side of the filling pipe to ensure that the device portions which can be adversely affected by air ingress or the loss of asepsis present an attack surface which is altogether as small as possible and in addition can be easily sterilized.

As a result of the inventive design of a filling valve in the direct proximity of the delivery orifice in the inner pipe of the filling pipe, the product to be filled can be reliably sealed in the inner space of the filling pipe up to the start of the filling operation and after the end of a product dosage. The space existing between the filling valve and the delivery orifice is optically small, so that, only if need be, a small quantity of air can be introduced on the filling pipe side when the filling pipe is placed onto a filling and extraction connecting piece. Because a longitudinal bore which is open toward the delivery orifice is provided according to the invention inside the valve stem, which longitudinal bore is connected to a device for producing a vacuum and supplying a protective gas and/or a sterilizing agent, the separation, defined in the object, between the product feed and evacuating, gassing and sterilizing measures is completely realised. When the filling valve is closed and the filling pipe put on, the filling and extraction connecting piece and also if necessary the flexible bag can be evacuated without problem through the longitudinal bore, for example before the start of the filling operation. Also, when the filling valve is closed again, the product surface can be gassed via the longitudinal bore after product dosaging is complete, again without the product which is retained in the filling pipe being exposed to this gassing operation. Finally, after a dosaging operation and completed removal of the filling pipe from the corresponding filling and extraction connecting piece, a sterilizing agent can be fed via the longitudinal bore, which sterilizing agent attends to the washing out of the delivery orifice.

The inventive design of the filling valve from a conical surface on the filling-pipe inner wall and a conical mating piece on the end of a valve stem enables the product feed pressure, while making allowance for the particular product viscosity, to be regulated without problem via an adjustment of the valve stem lift by a varying conical annular gap being exposed between the conical surface and the conical mating piece in accordance with the adjusted axial mobility of the stem shaft.

According to the method steps according to the invention, the device according to the invention enables a flexible bag to be filled under counterpressure without a top space having to remain in its filling and extraction connecting piece. However, if such a top space is desired for reasons determined by the product, it can be filled with inert gas before a closure cap is attached. An oxygen-fixing chemical or enzyme solution, for example, for protecting the surface against oxidation can also be sprayed into such a top space.

The plate bearing against the flexible bag and maintaining the counterpressure is at all events embodied in yielding manner with an adjustable pressure. During the entire filling operation, the plate remains in its position bearing against the bag in order to fully ensure the necessary counterpressure and the air-free filling. The product is then pressed into the bag through the filling valve against the pressure of the plate. The consequently existing positive pressure of the bearing plate maintains a positive pressure in the entire filling line and in the filling valve, which positive pressure is of the greatest importance during aseptic filling. Because of this inner positive pressure in the line, filling valve, etc., it is impossible for any germs to enter from outside however, when there is slight leakage or sealing damage, the product merely escapes to the outside During aseptic filling, the positive pressure ensures that filling is sterile.

These measures according to the invention differ in principle from the filling operations known from U.S. Pat. No. 4,120,134 dealt with at the outset, in particular in that the plate in the known device, which plate, in the invention, maintains the counterpressure during the entire filling operation, does not bear against the receptacle during filling but exclusively only during the lifting of the container closure cap until the start of filling and then again following the filling operation until a closure cap is attached onto the filled container. According to the invention, the corresponding bag or container is therefore always filled against the slight and adjustable pressure of the plate.

The flexible bag can have a capacity of 3 to 250 liters. It is of the greatest importance that the phase designated as "tending" does not occur when the bag is being filled. This is prevented by applying the plate on the opposite side of the filling plug against the flexible container wall, so that the product can only flow into the flexible container against the pressure of the plate. Once the filling operation is complete, there is absolutely no air in the plug or the filling valve. The whole space is filled with positive pressure, so that practically no air space whatever is present after lifting of the filling valve.

In addition to the evacuating of the bag before the start of the filling operation, the inside of the bag can also be sterilized with the device according to the invention. For such a sterilizing operation, the filling pipe is placed onto the filling and extraction connecting piece when the filling valve is closed and an appropriate sterilizing agent is fed through the longitudinal bore in the valve stem, which sterilizing agent, after a certain activation time is drawn off again while simultaneously evacuating the bag. If other receptacles are to be filled as flexible bags, for example glass bottles or cans, the receptacle inner space can be treated in the same method sequences. On a filling machine with several filling stations, such a sterilizing operation can also be carried out at another station from the filling of the product without the construction of the device having to be changed. The method sequences desired in each case merely have to be adjusted at the said device for producing the vacuum and for supplying a protective gas and/or a sterilizing agent.

Exemplary embodiments of the invention are described in greater detail below with reference to drawings, in which:

DESCRIPTION OF THE PREFERRED EMBODIMENTS

Figure 1:
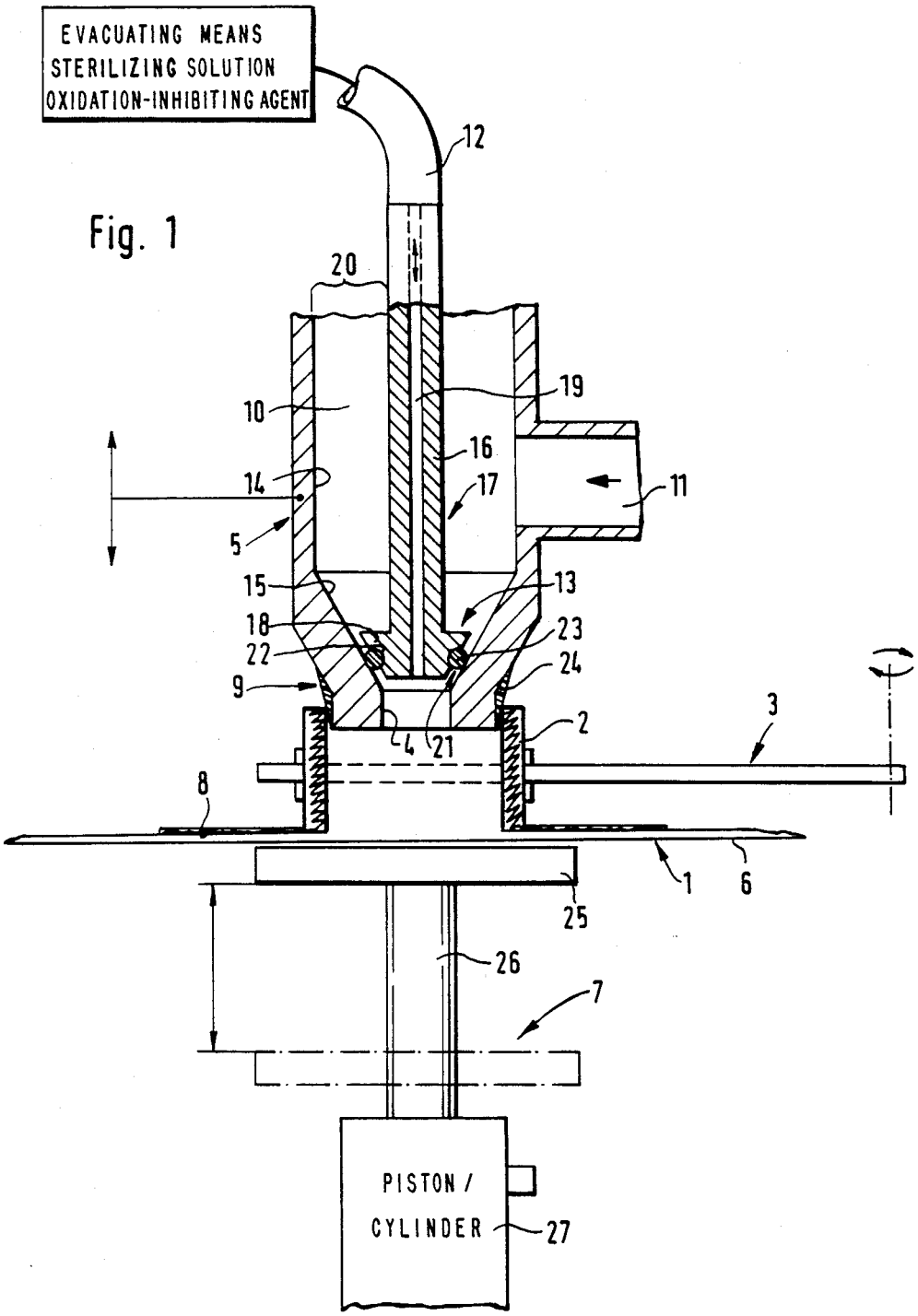
FIG. 1 shows schematic sectional view of a filling pipe of the device according to the features of the invention, which filling pipe is set against a filling and extraction connecting piece, with the parts of the device being located in positions as existing before the start of the filling operation.

According to FIG. 1, a schematically represented flexible bag 1 has a spout or filling and extraction connecting piece 2 which, while an edge 8 is formed on the inside of the bag, is connected to a flexible bag portion 6. The filling and extraction connecting piece 2, by means of a holding device 3, which can be made as grippers, is held in its alignment with a delivery orifice 4 of a filling pipe 5 provided above the filling and extraction connecting piece 2. Beneath the filling and extraction connecting piece 2, a displaceable pressure element 7 engages on the flexible bag portion 6, which pressure element 7 has a pressure plate 25 which is connected to a piston 26 of a variable pressure piston-cylinder unit 27 and can be displaced between the positions identified in the drawing by the double arrow.

At its outer end facing toward the delivery orifice 4, the filling pipe 5 has a discharge nozzle or sealing cone 9 which has an elastic seal 24 at its engagement area with the upper edge of the filling and extraction connecting piece 2. Such a seal is especially advantageous if the sealing cone is attached to a filling and extraction connecting piece of a container made of an inflexible material, for example to a glass bottle or can. In connecting pieces made of plastic or other elastic materials, this seal 24 could even be omitted. In the direct proximity of the delivery orifice 4, a filling valve 13 is formed in the transition area between this orifice and the filling-pipe inner wall 14, which filling valve 13 consists of a conical surface 15 on the filling-pipe inner wall 14 and a conical mating piece 18 which is arranged on the end of a stem shaft 16 of a valve stem 17 guided concentrically in axially movable manner in the filling pipe 5. A longitudinal bore 19 runs through the longitudinal center axis of the valve stem 17 and also passes through the conical mating piece 18 and, when the filling valve 13 is closed, as shown, leads into the delivery orifice 4. Located between the conical mating piece 18 and the conical surface 15 is an elastic seal 21 which, as shown, can consist of an O-ring 23 which is inserted into a peripheral groove 22 made in the peripheral surface of the conical mating piece 18.

The interior 10 of the filling pipe 5, because of the arrangement of the valve stem 17, is turned into an annular space 20 into which a product feed line 11 enters through the wall of the filling pipe 5. The longitudinal bore 19 in the valve stem 17 is in connection with a device (not shown) via a further line 12, which connection is used for producing a vacuum and supplying a protective gas and/or a sterilizing agent to the longitudinal bore 19.

The functional mode of the device is described in greater detail below in a typical filling operation at a filling machine station suitable for this purpose. In an appropriate filling machine station, in the working area of the filling pipe 5 or the pressure element 7, devices are located, which for the sake of simplicity are not depicted, such as, for example, a device for gripping, removing and attaching a closure cover onto the filling and extraction connecting piece 2 and also various control and inspection elements.

The flexible bag 1, together with its filling and extraction connecting piece 2, is inserted manually or automatically into the holding device 3 and fixed there. The portion 6 of the bag 1 is laid onto the pressure plate 25 and the latter is raised into its upper position shown in solid lines. When the connecting piece is provided with a closure cover, the latter is now removed by a removal device and swung away from the connecting piece opening, to the side. The filling pipe 5 is now lowered into the opening of the filling and extraction connecting piece 2, engages on the upper edge of the connecting piece via the sealing cone 9 and the elastic seal 24 and thus seals the inner space of the connecting piece. The plate remains in its upper position until the bag is closed again and is ejected automatically from the connecting-piece holding device.

If, for example, in addition to a closure cap, another sealing foil is stretched over the opening of the connecting piece 2, the latter is pierced through when the filling pipe 5 is lowered. The filling pipe 5 can also be arranged such that it cannot be moved axially and the bag 1 on the connecting piece 2 can be set against the sealing cone 9 by lifting of the pressure plate 25 by means of the variable pressure piston-cylinder unit 27.

A vacuum applied to the line 12 and the longitudinal bore 19 via the evacuating device (not shown) now removes the air located in the inner space of the connecting piece and if necessary in the flexible bag portion. Subsequently thereto, the valve stem 17 is displaced out of its indicated closing position via actuating elements (also not shown), and the product can pass into the inside of the bag via the product feed line 11. At the same time, a pressure corresponding to the product feed acts against the pressure plate 25 and guarantees an appropriate pressure distribution inside the flexible bag portion 6. Once the desired product dosage has been filled, the filling valve 13 is closed by an appropriate downward displacement of the stem shaft 16 and therefore the product located in the annular space 20 and in the product feed line 11 is separated from the product already filled. The filling pipe 5 is now lifted from the filling and extraction connecting piece 2 and the latter is closed.

In order to avoid any admission of air during the lifting of the filling pipe 5 until the closure cap is placed on completely, inert gas can be allowed to flow out via the longitudinal bore 19 at the start of the lifting operation, under the protection of which inert gas the closure cap can be placed onto the connecting piece without the risk of air being admitted to the momentarily exposed product area inside the connecting piece.

In the manner described, the flexible bag 1 can be filled, empty of air, up to the upper edge of its filling and extraction connecting piece or filled up only to such an extent that a certain top space or void remains inside the connecting piece or between the product and the closure cap. Inert gas can likewise be blown into this top space for the purpose of oxidation inhibition, or further protective spray media can be applied to the product surface which prevent a surface fermentation and mold growth. Gas and liquid can also be thrust into the inside of the bag together against the applied force of the plate.

After the filling and extraction connecting piece 2 has been closed, the pressure plate 25 is lowered into its position shown in chain-dotted lines and the bag is released from the holding device 3. The filling operation is now complete and the bag is accordingly conveyed away.

So that the delivery orifice 4 is free of product residues, bacteria and germs for the following filling operation of a further bag, a sterilizing solution, shortly before a further filling operation is restarted, can preferably be flushed via the longitudinal bore 19 for washing the delivery orifice 4. Following this sterilizing operation, some sterilizing agent still remains in the longitudinal bore 19, which sterilizing agent, during the evacuation, before the filling operation to follow, is used for sterilizing the vacuum line by back flushing.

The vacuum line and the inside of the valve stem are sterilized and cleaned by this return suction of the sterilizing agent during evacuation. The self-sterilization of the valve both during evacuation through the longitudinal bore 19 and also the reverse operation of through-flushing of the longitudinal bore 19 in the filling direction in the non-operative position of the filling valve guarantee perfectly aseptic filling.

The pressure plate 25 of the pressure element 7 can be adapted to the most varied bag forms and can be made, for example, slightly convex or concave. The surface of the pressure plate 25, which surface faces toward the bag portion, can also be made padded. The counterpressure exerted via the pressure plate 25 can be varied at the variable pressure piston-cylinder unit 27.

If a flexible bag 1 is to be sterilized before filling, this can also take place by means of the device depicted. In the case of a non-sterilized bag, its connecting piece is guided into the holding device 3 in just the same way as described above, and the filling pipe 5, when the filling valve 13 is closed, is inserted into the filling and extraction connecting piece 2. After the pressure plate 25 has been lowered, atomized $H_2O_2$ is blown through the longitudinal bore 19 into the inside of the bag. The dosage rate is controlled, for example, by a solenoid valve. A likewise controlled quantity of a catalase mist is then introduced into the inside of the bag through the longitudinal bore 19. After a certain reaction time, the bag is again emptied by vacuum in the following evacuation operation. The pressure plate 25 is then moved again into its upper position and the filling operation can start in the manner described above.

In summary, it can be stated that maintaining and regulating the positive pressure inside the entire product feed line 11 via the valve stem 17 is of the greatest importance. Depending on the viscosity of the product, the positive pressure in the feed line 11 can be regulated via the valve stem 17 at any level whatsoever, and moreover a positive pressure can be produced and maintained by the pressure plate until the product is effectively pressed into the flexible bag.

Figure 2:
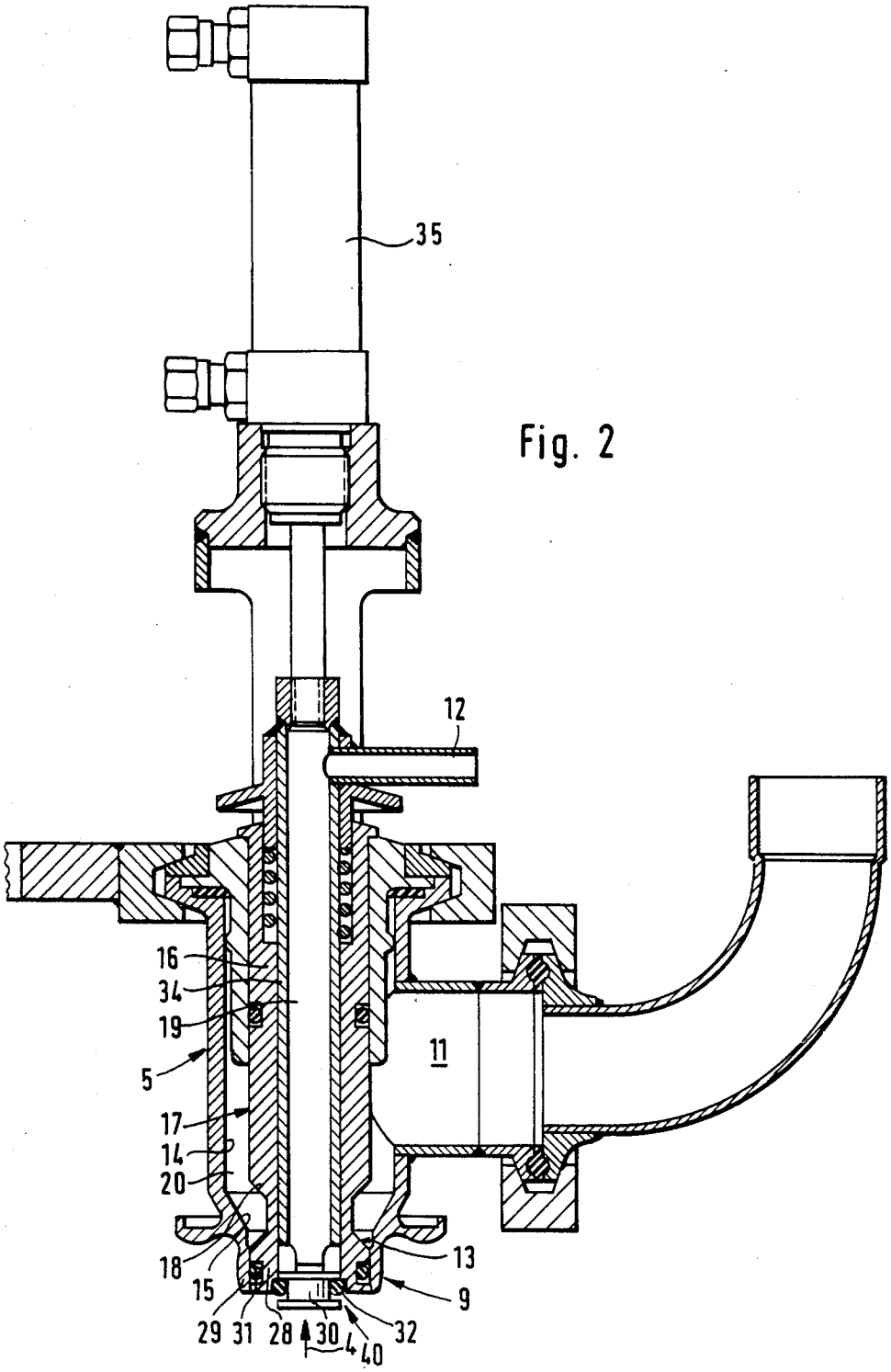
FIG. 2 shows a modified embodiment of a filling pipe.

The modified embodiment, shown in FIG. 2, of a filling pipe 5 has a filling-valve closure arrangement 40 at the end area facing toward the delivery orifice 4. This filling-valve closure arrangement 40 is located in the discharge direction of the product flow beneath the portion of the filling valve 13, which portion is formed by the conical surface 15 and the conical mating piece 18, and consists of a sleeve-shaped orifice extension 29 and a cylindrical valve member 28 which is guided in sliding manner in the orifice extension 29. An elastic seal 31 is provided between the cylindrical valve member 28 and the sleeve-shaped orifice extension 29. When the valve stem 17 is displaced against the discharge direction of the product flow, the cylindrical valve member 28 slides upwards according to FIG. 2 in the sleeve-shaped orifice extension 29 and, as it passes over into the widened annular space 20 (FIG. 1), it clears the orifice opening 4 for the product discharge.

A stem-shaft sleeve 34 is guided in longitudinally displaceable manner inside the valve stem 17. This stem-shaft sleeve 34 has inside of it the longitudinal bore 19 which has the function described with reference to FIG. 1. Attached to the end of the stem-shaft sleeve 34, which end faces toward the delivery orifice 4, is a valve disk 30 which enables the longitudinal bore 19 to be opened and closed in controllable manner. For this purpose, the valve disk 30, with an elastic peripheral seal 32, as is apparent in the closing position according to FIG. 2, engages on the opening edge of the valve member 28 and thus seals the longitudinal bore 19 relative to the discharge end of the filling pipe 5. The longitudinal bore 19 is opened by a displacement of the stem-shaft sleeve 34 in the product discharge direction, with the valve disk 30, together with the peripheral seal 32, lifting from the opening edge of the valve member 28 and with the longitudinal bore 19 consequently opening. During this relative displacement of the stem-shaft sleeve 34, the valve stem 17, because of the stops shown in FIG. 2, remains in its position indicated, so that the filling valve closure arrangement 40 remains closed. Only after the longitudinal bore 19 is closed again via the valve disk 30 and the peripheral seal 32 by a corresponding return displacement of the stem-shaft sleeve 34 does the stem-shaft sleeve 34 carry the valve stem 17 along during a continued return movement, lift the valve stem 17 and thus open the product through-flow. Provided at the end area of the stem-shaft sleeve 34, which end area is remote from the delivery Orifice 4, is a pneumatically operable piston-cylinder unit 35 which, appropriately controlled, produces the displacements described.

By controlling the opening and closing of the longitudinal bore 19, the feed of sterilizing agent, inert gas, enzyme solutions, oxidation-inhibiting agent and the like can on the one hand be accurately controlled for pressure and quantity, the degree of evacuation can also be precisely determined and moreover an even more favorable separation than in the exemplary embodiment according to FIG. 1 can take place between the product flow and the supply of a protective gas in order to produce a vacuum or introduce sterilizing agents.

I claim:

1. Apparatus for filling a flexible bag having a body, a closed end, and an open end including a spout defining an opening in the bag, said apparatus comprising:
- filling means for filling the bag, said filling means including a discharge nozzle;
- inserting means for inserting said nozzle of said filling means into the spout of the bag;
- attaching means for attaching the spout of the bag to said nozzle of said filling means;
- moving means for moving the closed end of the bag toward the open end of the bag until the body of the bag is substantially collapsed onto itself, whereby the body of the bag is at least partially evacuated;
- evacuating means for evacuating the spout and the body of the bag through said nozzle of said filling means;
- supporting means for yieldingly supporting said moving means and hence the closed end of the bag while the bag is being substantially filled through said nozzle of said filling means, whereby the bag expands against a counterpressure as it is filled, said supporting means relieving the counterpressure exerted on the bag by moving said moving means away from the closed end of the bag after the bag has been substantially filled;
- terminating means for terminating the filling of the bag;
- detaching means for detaching the spout of the bag from said nozzle of said filling means; and
- removing means for removing said nozzle of said filling means from the spout of the bag.

2. Apparatus according to claim 1, wherein the bag is attached to said filling means by placing the spout of the bag over said nozzle of said filling means.

3. Apparatus according to claim 1, wherein the bag is attached to said filling means by inserting said nozzle of said filling means into the opening in the bag.

4. Apparatus according to claim 1, wherein said moving means includes a support plate which is movable between an extended position and a retracted position and wherein said supporting means includes a piston-cylinder unit, said piston-cylinder unit including a reciprocating piston attached to said support plate so as to move said support plate between its extended position and its retracted position.

5. Apparatus according to claim 4, wherein the body of the bag is collapsed when said support plate is in its extended position.

6. Apparatus according to claim 5, wherein said support plate moves from its extended position towards its retracted position in response to the filling of the bag, whereby the counterpressure is exerted on the bag through said support plate.

7. Apparatus according to claim 6, wherein said piston-cylinder unit is of the variable pressure type, whereby the counterpressure can be adjusted by varying the pressure of said piston-cylinder unit.

8. Apparatus according to claim 4, wherein the bag includes a closure for the opening in the bag and said support plate is moved to its extended position before removing the closure from the opening in the bag, said support plate remaining in its extended position while the closure is removed, the bag is completely filled and the closure is replaced, whereby the bag can be filled without permitting any significant admission on air into the bag.

9. Apparatus according to claim 1, wherein said nozzle of said filling means has an outlet positioned so as to communicate with the opening in the bag, an inner passageway connectable with said outlet, and an outer passageway connectable with said outlet.

10. Apparatus according to claim 9, wherein said evacuating means evacuates the sport and body of the bag by applying a vacuum to said inner passageway of said nozzle when said inner passageway is connected to said outlet of said nozzle.

11. Apparatus according to claim 10, wherein the bag is filled by delivering a product to the bag through said outer passageway of said nozzle when said outer passageway is connected to said outlet of said nozzle.

12. Apparatus according to claim 11, wherein said terminating means terminates the filling of the bag by preventing the product from flowing from said outlet of said nozzle.

13. Apparatus according to claim 12, wherein said terminating means includes a valve.

14. Apparatus according to claim 13, wherein said valve includes an axially displaceable stem through which said inner passageway extends.

15. Apparatus according to claim 14, wherein said valve stem is movable in an axial direction between an open position, in which the product is permitted to flow from said outer passageway to said outlet, and a closed position, in which the product is prevented from flowing from said outer passageway to said outlet.

16. Apparatus according to claim 15, further comprising flushing means for flushing said outlet of said nozzle by delivering a sterilizing solution to said outlet through said inner passageway while said valve stem is in its closed position and after the bag has been detached from said filling means.

17. Apparatus according to claim 15, further comprising spraying means for spraying an oxidation-inhibiting agent onto the product delivered to the bag after said valve stem has been moved to its closed position and during the removal of the bag from said filling means, the oxidation-inhibiting agent being sprayed through said inner passageway of said nozzle in an amount sufficient to fill any void remaining in the bag after its filling with the product.

18. Apparatus according to claim 15, further comprising delivering means for delivering a sterilizing agent to the bag through said inner passageway of said nozzle when said valve stem is in its closed position, maintaining means for maintaining the sterilizing agent in the bag for a predetermined length of time, and withdrawing means for withdrawing the sterilizing agent from the bag through said inner passageway of said nozzle while said valve stem remains in its closed position, whereby the bag can be sterilized prior to filling it with the product.

* * * * *